US005669249A

United States Patent [19]

Ando'

[11] Patent Number: 5,669,249

[45] Date of Patent: Sep. 23, 1997

[54] MAGNETIC SELECTION RING FOR AN ELASTIC SELECTOR FOR NEEDLES IN A CIRCULAR KNITTING MACHINE

[75] Inventor: Jan Ando', Scandicci, Italy

[73] Assignee: Matec S.r.l., Scandicci, Italy

[21] Appl. No.: 605,461

[22] Filed: Feb. 26, 1996

[30] Foreign Application Priority Data

Mar. 3, 1995 [IT] Italy ..... B095A0079

[51] Int. Cl.[6] ..... D04B 15/78

[52] U.S. Cl. ..... 66/219; 66/75.2

[58] Field of Search ..... 66/219, 220, 221, 66/222, 223, 72.2, 215, 216, 218

[56] References Cited

U.S. PATENT DOCUMENTS

| | | | |
|---|---|---|---|
| 3,812,691 | 5/1974 | Engelfried | 66/219 |
| 4,033,148 | 7/1977 | Mureso . | |
| 4,320,635 | 3/1982 | Cuche et al. | 66/220 |
| 5,520,024 | 5/1996 | Ando' | 66/219 |

FOREIGN PATENT DOCUMENTS

| | | | |
|---|---|---|---|
| 474195 | 3/1992 | European Pat. Off. | 66/219 |
| 0 503 216 | 9/1992 | European Pat. Off. . | |
| 0 677 605 | 10/1995 | European Pat. Off. . | |
| 2 030 533 | 11/1970 | France . | |
| 2 254 057 | 5/1974 | Germany . | |

*Primary Examiner*—C. D. Crowder
*Assistant Examiner*—Larry D. Worrell, Jr.
*Attorney, Agent, or Firm*—Welsh & Katz, Ltd.

[57] ABSTRACT

The magnetic selection ring has a ferromagnetic body defining a flange provided with recesses. Slots filled with diamagnetic material are provided in the recesses to form heads each accommodating the core of a respective release electromagnet. The selection ring is usable with selectors of the type provided with a shaped elastic portion, a lower heel, which is outwardly flexible for being affected by a lifting cam or inwardly retainable to avoid interference with the cam, and an upper heel, actuated by a lowering cam formed on the lower surface of a complementary ring for retaining the elastic portions of the selectors. The selectors have a lowermost tapering tab, which can be moved by a retraction cam into contact with the magnetic ring. When the tab is retained by the permanent magnets, the heel assumes the configuration for not interfering with the cam. The electromagnets are activatable for selectively releasing the selectors.

4 Claims, 3 Drawing Sheets

Fig. 1
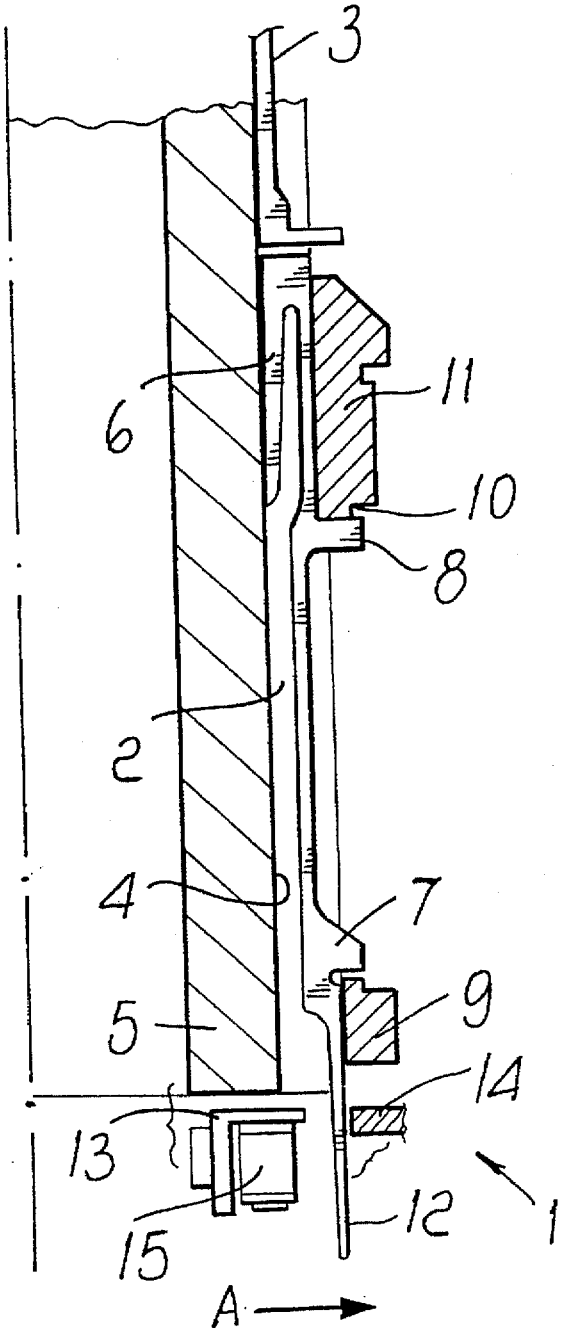
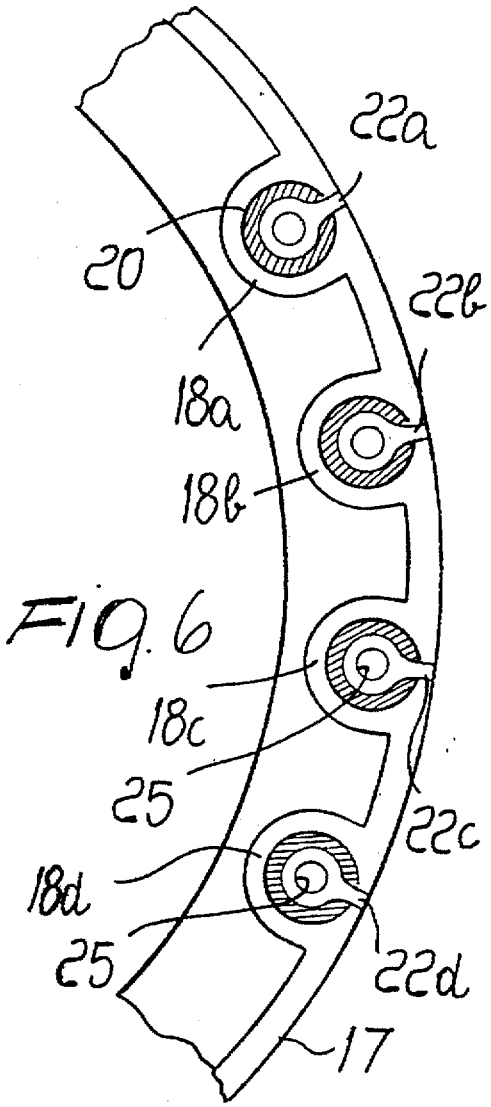
Fig. 6
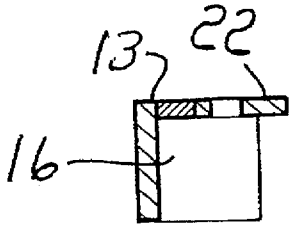
Fig. 7

MAGNETIC SELECTION RING FOR AN ELASTIC SELECTOR FOR NEEDLES IN A CIRCULAR KNITTING MACHINE

BACKGROUND OF THE INVENTION

The present invention relates to a magnetic selection ring for an elastic selector for needles in a circular knitting machine, particularly for producing socks or the like.

Circular knitting machines for producing stockings, socks, tubular products, possibly having large diameters, or the like, have a cylinder that is provided with a usually vertical axis and is affected by a plurality of longitudinal peripheral millings wherein respective needles, sub-needles, and selectors are mounted so as to be vertically slideable.

In order to modify the characteristics of the product being knitted, during the rotation of the cylinder, and at very specific angular positions, certain needles must be raised by a certain extent with respect to the vertical level whereat they are located; this is achieved by means of the selectors, which can be actuated by respective cam profiles for upward or downward movement.

Most known devices select the selectors by pressing them towards the inside of the cylinder, thereby necessitating additional preselection cams for extracting all the selectors in their seats towards the outside of the cylinder prior to actual selection, with the result of reducing the angular portion available for selection due to the presence of the extraction cams.

In some machines provisions have been made to retain all the selectors against a magnetic ring located inside the cylinder and to release, with localized magnetic pulses, only the selectors to be selected. Upon being released, the selected selectors return elastically outward with their heels in the configuration for engagement with lifting cams.

In order to achieve good operation of the machine, in the magnetic selector retention ring the points of release with localized magnetic pulses must be small and must be located and provided with high precision.

The shift, inside the cylinder, of the magnetic selector retention ring, and the precision and small space occupation of the electromagnetic release points of the selectors allows to enormously reduce the space occupation linked to the provision of the selection points as well as to simplify the machine.

SUMMARY OF THE INVENTION

A principal aim of the present invention is therefore to provide a magnetic selection ring for an elastic selector for needles in a circular knitting machine that allows to select the needles at will and according to requirements, without having to modify or replace other parts of the machine.

An object of the present invention is to provide a magnetic selection ring for an elastic selector for needles in a circular knitting machine that has a compact size and allows very precise selection.

Within the scope of this aim, another object of the present invention is to achieve the above aim and object with a structure that is simple, relatively easy to manufacture, safe in use, effective in operation, and has relatively low costs.

In accordance with the invention, there is provided a magnetic selection ring for an elastic selector for needles in a circular knitting machine, which is characterized in that it comprises a fixed annular permanent magnet arranged towards the inside of the cylinder, and a plurality of electromagnets formed in the peripheral region of the fixed annular permanent magnet. The activation of the electromagnets is adapted to cause the selective release of respective downward extension tabs of the selectors which are otherwise retained by the permanent magnet during cylinder rotation.

BRIEF DESCRIPTION OF THE DRAWINGS

Further characteristics and advantages of the present invention will become apparent and evident from the following detailed description of a preferred but not exclusive embodiment of a magnetic selection ring for an elastic selector for needles in a circular knitting machine according to the invention, illustrated only by way of non-limitative example in the accompanying drawings, wherein:

FIG. 1 is a schematic sectional side view, taken along a vertical plane, of a selection device wherein a magnetic selection ring according to the invention can be installed;

FIGS. 6 and 7 are respectively a plan view and a sectional elevation view, in enlarged scale, of a detail of the ring;

DESCRIPTION OF THE PREFERRED EMBODIMENTS

Figure 2:
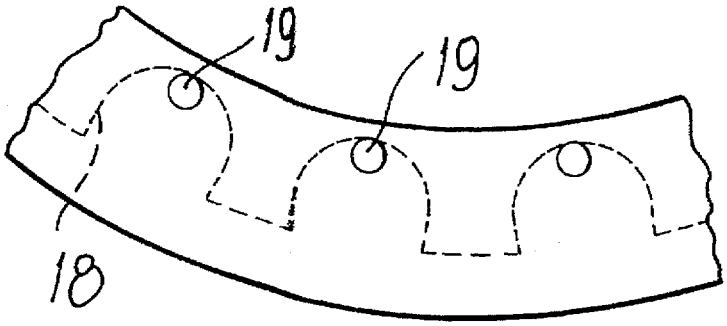
FIGS. 2, 3, 4, and 5 are plan views of portions of the ring according to the invention during successive production steps.

With particular reference to the above figures, the reference numeral 1 generally designates a selection device for an elastic selector 2 for needles 3 in a circular knitting machine according to the invention.

The selectors and the needles are mounted in a conventional manner at respective longitudinal millings 4 that are distributed along the lateral surface of the cylinder 5.

The elastic selector 2, in the example illustrated in FIG. 1, is provided, in an upward region, with a shaped elastic portion 6 that is folded in two and is adapted to return the lower portion towards the outside of the cylinder (arrow A): the selector has a lower heel 7 and an upper heel 8.

The lower heel 7 is adapted to return elastically outwards in a position for being affected by a lifting cam 9 or to be retained towards the cylinder axis in a configuration wherein it does not interfere with the cam 9.

The upper heel 8 is actuated downwardly by a lowering cam 10 formed on the lower surface of a complementary ring 11 for retaining the portions 6 of the selectors 2.

In a downward region, the selectors continue with a tapering tab 12 adapted to be attracted and retained by a fixed magnetic selection ring 13, which is arranged towards the inside of the cylinder: a retraction cam 14 is mounted on the outside of the cylinder and is adapted, at each turn of the cylinder, to move the tab 12 into contact with the magnetic ring 13; when the tab 12 is retained by the ring 13, the heel 7 assumes the configuration for not interfering with the cam 9.

A plurality of small selection electromagnets 15 are fitted in the magnetic ring 13, and their activation is adapted to cause the selective release of the selectors, which are otherwise retained by the permanent magnet during the rotation of the cylinder.

Figure 3:
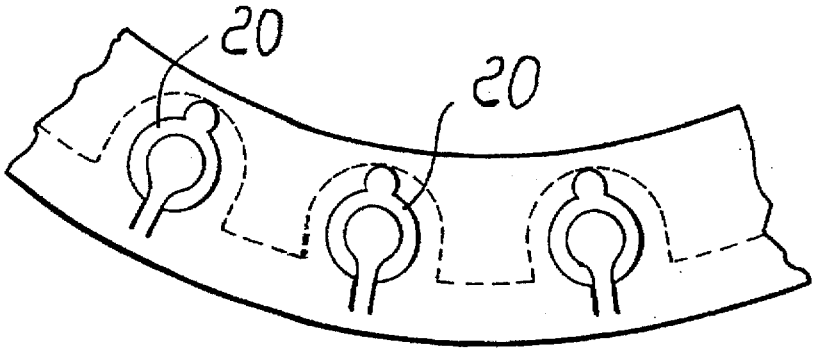

The ring 13 is constituted by a body made of ferromagnetic material that comprises a solid annular region 16 having a substantially square cross-section which continues on one side with an external flange 17: a plurality of arc-like recesses 18*a*, 18*b*, 18*c*, 18*d* etcetera are formed in the solid region in very specific angular positions; through holes 19 (FIG. 2) and then (FIG. 3) slots 20, which are shaped like a ring that is open radially towards the outside of the flange and are meant to be filled with diamagnetic material 21 (advantageously applied by braze welding) to form, in the flange, respective heads 22*a*, 22*b*, 22*c*, 22*d*, etcetera (FIG. 6) made of ferromagnetic material for the release electromagnets, are formed at the recesses in the outer flange 17; the usable diamagnetic material can be, for example, a silver-copper eutectic alloy.

Figure 4:
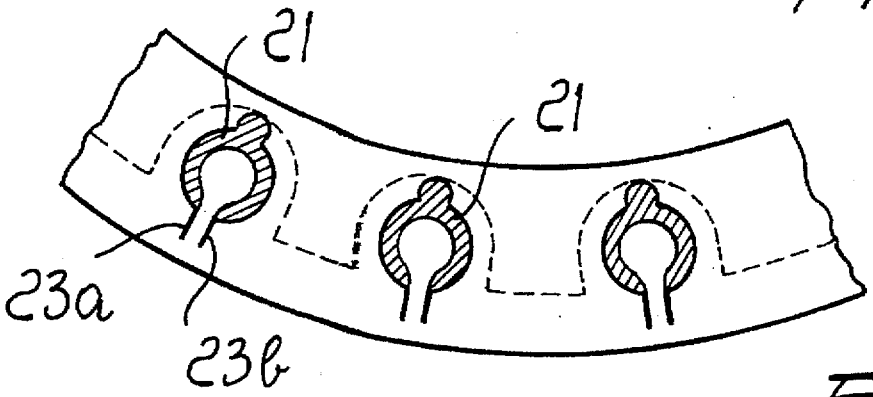
Figure 5:
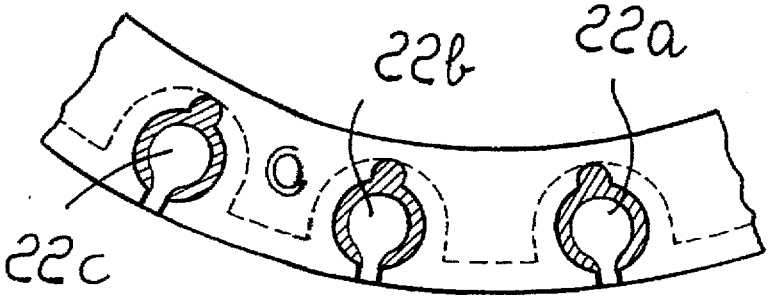
Figure 8:
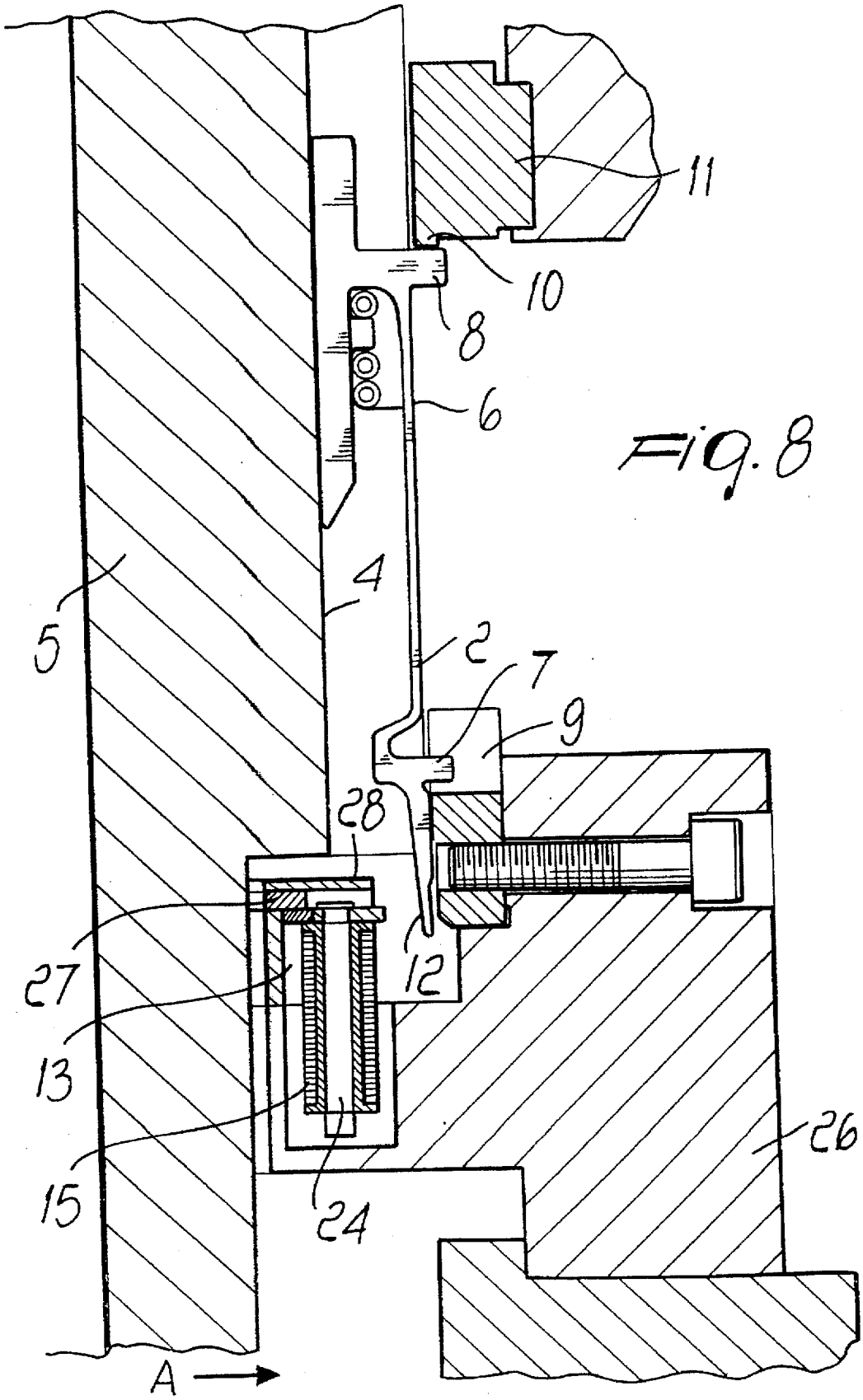
FIG. 8 is an enlarged-scale side view of the ring according to the invention in assembled condition.

The slots 20 are formed by electrical discharge machining with lines continuing with thin radial portions 23*a* and 23*b* (FIG. 4) that do not reach the edge of the flange 17: the physical separation of the heads 22 from the flange 17 is performed after filling the slots with the diamagnetic material, by removing the peripheral annular portion of the flange 17 (FIG. 5).

The heads 22 are each provided with a central hole for the insertion of the core 24 of the respective release electromagnet 15.

The ring 13 is formed by two half-parts, which are shaped like a half-circle and are fixed by screws, the position whereof is designated by the reference numeral 25, to a fixed drum 26 arranged outside the cylinder and located directly below the region affected by the selectors 2. A plurality of sectors 27 of permanent magnets are distributed above the ring 13, and a disk 28 of soft iron is packed on the sectors. The sectors 27, the disk 28, and the ring 13 produce a magnetic ring capable of retaining the tabs 12 that are moved into sliding contact against the surface of the magnetic ring.

The operation of the selection device according to the invention is evident: during the rotation of the cylinder, the selectors are moved by the cam 14 so that the tabs 12 are retained by the magnetic ring 13 and the heels do not interfere with the cam 9: according to the requirements, the electromagnets 15, the polarity whereof is opposite to the polarity determined by the permanent magnets 27, are activated, causing (by cancelling out the attraction of the disk) the release of the selectors as they pass in front of it; the heel 7 of the selected selector assumes the configuration for interfering with the cam 9, which can thus lift it: the cam 10 then returns the selector to the lowered position.

It should be noted that in the described device it is not necessary for the selectors 2 to be selected when they are at a specific height, since by giving the tab 12 an appropriate length it is possible to release the selectors when they pass at different vertical levels in front of the electromagnet.

It should also be noted that the device according to the invention is very compact and occupies a small amount of space, in practice requiring only the placement of the ring 13 and of the electromagnets 15.

The invention thus conceived is susceptible of numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the appended claims.

What is claimed is:

1. A magnetic selection ring for an elastic selector for needles in a circular knitting machine, comprising:

a fixed annular permanent magnet arranged towards an inside of a cylinder of the knitting machine for retaining a downward extension tab of the elastic selector during rotation of the cylinder;

a plurality of electromagnets formed in a peripheral region of said fixed annular permanent magnet, such that an activation of said electromagnets causes a selective release of the extension tab of the elastic selector;

a body of the annular permanent magnet made of ferromagnetic material including a solid annular region with a substantially square cross-section and, on one side of the solid annular region, an external flange;

a plurality of recesses formed in the solid annular region;

slots formed in the external flange at said recesses and being open radially outwardly of the external flange; and diamagnetic material filled in said slots to form, in the flange, respective heads made of ferromagnetic material for said electromagnets.

2. The magnetic selection ring of claim 1, wherein said slots are formed by electrical discharge machining, and wherein a physical separation of said heads from the flange is performed after filling said slots with said diamagnetic material, and wherein said heads are provided with a central hole for inserting a core of a respective electromagnet.

3. A magnetic selection ring for being fixed relative to a plurality of elastic selectors slidably guided in a rotatable needle cylinder of a circular knitting machine for selectively retaining the elastic selectors, comprising:

a ring made of ferromagnetic material and comprising a solid annular region;

a plurality of sectors of permanent magnets connected to said ring;

a plurality of heads made of ferromagnetic material arranged inside said solid annular region of said ring and being magnetically isolated with respect to the ferromagnetic material of said ring, each of said heads having a terminal portion arranged at an external surface of said ring for contact with the elastic selectors; and a plurality of selection electromagnets each of which is mounted at a respective head.

4. In combination, a magnetic selection ring fixed relative to a plurality of elastic selectors slidably guided in a rotatable needle cylinder of a circular knitting machine, comprising:

a ring made of ferromagnetic material and comprising a solid annular region;

a plurality of sectors of permanent magnets connected to said ring;

a plurality of heads made of ferromagnetic material arranged inside said solid annular region of said ring and being magnetically isolated with respect to the ferromagnetic material of said ring, each of said heads having a terminal portion arranged at an external surface of said ring for contact with the elastic selectors; and a plurality of selection electromagnets each of which is mounted at a respective head, for selectively retaining the elastic selectors.

* * * * *